United States Patent [19]

Haynes et al.

[11] 4,377,509

[45] Mar. 22, 1983

[54] PACKAGING FOR OCEAN DISPOSAL OF LOW-LEVEL RADIOACTIVE WASTE MATERIAL

[75] Inventors: Harvey H. Haynes, Camarillo; Robert D. Rail, Ojai, both of Calif.

[73] Assignee: The United States of America as represented by the Secretary of the Navy, Washington, D.C.

[21] Appl. No.: 167,851

[22] Filed: Jul. 14, 1980

[51] Int. Cl.[3] ..... G21F 9/24

[52] U.S. Cl. ..... 252/633; 206/521; 220/2.3 R

[58] Field of Search ..... 220/2.3; 206/54; 252/633; 250/506

[56] References Cited

U.S. PATENT DOCUMENTS

| | | | |
|---|---|---|---|
| 3,760,753 | 9/1973 | Mertens | 252/633 |
| 4,222,889 | 9/1980 | Uerpmann | 252/633 |
| 4,257,912 | 3/1981 | Fleischer et al. | 250/506 |

OTHER PUBLICATIONS

*Nucleonics*, "Nuclear Engineering"; Ocean Disposal of Radioactive Waste, Dec. 1954.

*Primary Examiner*—Brooks H. Hunt

*Attorney, Agent, or Firm*—Robert F. Beers; Joseph M. St.Amand

[57] ABSTRACT

A packaging system for storage of containers of low-level radioactive waste consisting of a concrete shell structure that houses the containers and a dry filler material that surrounds them. Void volume in the filler material is saturated with water, and during free-fall descent to the seafloor, a pressure compensation means equalizes pressures inside and outside the packaging structure and forces the filler material into intimate contact about the drums; on the seafloor, the filler material hardens to produce a highly secure barrier to any leaking of radioactive waste.

23 Claims, 4 Drawing Figures

PACKAGING FOR OCEAN DISPOSAL OF LOW-LEVEL RADIOACTIVE WASTE MATERIAL

BACKGROUND OF THE INVENTION

This invention relates to safely packaging low-level radioactive waste materials for disposal in the ocean, and more specifically, to providing a packaging system that has a life expectancy which will exceed the length of time (over 100 years) necessary for the low-level radioactive way to decompose or radiodecay to environmentally innocuous materials.

Present methods for ocean disposal of low-level radioactive wastes use 55 gallon steel drums which are either pressure-compensated or monolithic (solid). Typically the drums are of the monolithic type by being tightly sealed after filling with a matrix. The matrix is either an asphaltic (bitumen) material mixed with about an equal volume of solid radioactive waste material or a cement/sand mixture combined with waste in an approximate ratio of 3 to 1 parts by volume.

The drums are transported to the ocean dump site and discharged by free falling to the seafloor.

An onsite inspection of drums containing a cement matrix 22 years after disposal at 1,000 m water depth showed that the most common mode of failure was crushing of the drums because the strength of the matrix was not sufficient to withstand the pressure loads from the ocean environment. Corrosion of steel was evident; however, breached drums showed more distress from corrosion because attack occurred both internally and externally.

The European Community presently uses an asphalt matrix which provides good support to the drum in resisting collapse. However, the corrosion problem of the steel still exists.

Other systems adapted for burial on land use containers for holding a plurality of standard steel drums with foamed polyurethane surrounding and occupying the spaces between drums. This system, however, is unsuitable for deep ocean disposal because of ease in rupture of the container and foam.

Mixing radioactive wastes with dry cement in a canister, alone, where a breach in the canister will permit entry of water from a storage tank to form a concrete patch against leakage of wastes will not work satisfactorily at deep ocean depths due to high pressure leaks, buckling, and exposure of wastes to the biosphere.

The state of art at present needs improvement because 55-gallon drums do not offer a safe barrier in isolating radioactivity from the environment. It is estimated that for the low-level waste, a sufficient barrier system should contain the radioactive material for ten half-lives. This places a requirement on the packaging method for a life of 100 to 200 years.

SUMMARY OF THE INVENTION

The invention is basically a packaging system that stores conventional 55-gallon drums of low-level radioactive waste. The package consists of a concrete shell structure that houses the drums and a filler material that surrounds the drums. The filler material is placed around the drums as a dry mixture of sand and cement. After transport to the ocean site and just prior to ocean implacement, the void volume in the filler material is saturated with water. Then during free-fall descent to the seafloor, a pressure compensation means is used to equalize pressures inside and outside the packaging structure. Once the package is on the seafloor, the filler material hardens to produce a highly secure barrier to any leaking of radioactive waste.

DESCRIPTION OF THE PREFERRED EMBODIMENTS

Figure 1A:
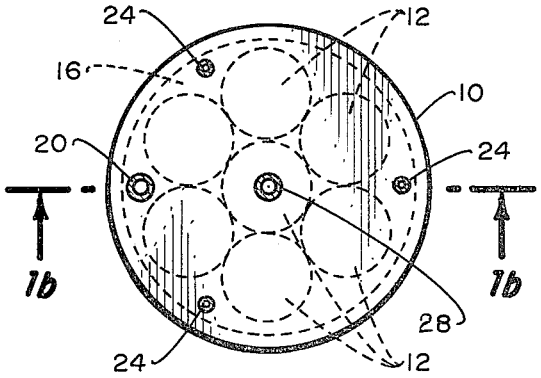
FIG. 1*a* is a plan view of a preferred embodiment of the invention for packaging low-level radioactive wastes for deep ocean disposal.
Figure 1B:
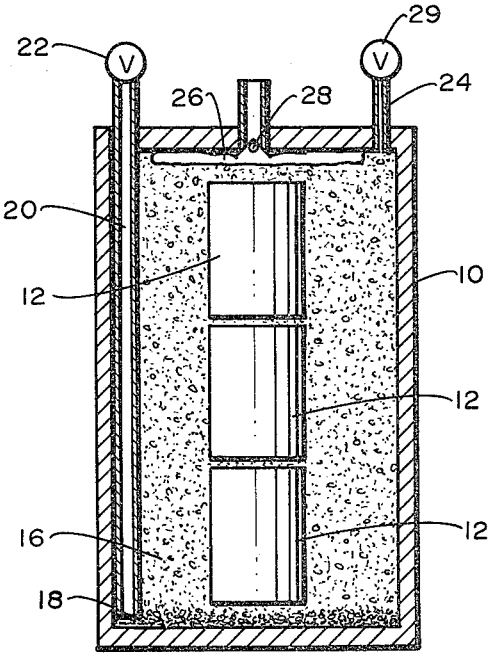
FIG. 1*b* is a cross-sectional elevational view of the packaging structure taken along line 1*b*—1*b* of FIG. 1*a*.

In FIG. 1*a*, which shows a plan view and FIG. 1*b* which shows cross-sectional elevation view of one packaging structure, a non-degradable shell 10 of reinforced/pre-stressed concrete for example, forms the exterior of the structure. Contained within the shell 10 are conventional 55-gallon steel drums 12 which enclose the low-level radioactive waste. FIGS. 1*a* and 1*b* show a configuration wherein a total of 21 drums are packaged; the drums are seven per layer as shown in FIG. 1*a* and are stacked three layers high as shown in FIG. 1*b*. Other numbers and packaging arrangements of the drums are also practical. The space between the drums 12 is compacted with a hardenable filler material 16. Filler material 16 can be any suitable liquid or moldable viscous solid which will prevent corrosion of the steel drums 12 and operate to contain any leakage of waste from inside the drums. For the present example the filler material 16 is considered to be a mixture of dry ingredients of portland cement concrete. That is, the mixture consists of cement and aggregates, but not the water. On the bottom of the shell 10 is a layer of large aggregate 18 which permits water to be evenly distributed across the bottom. The water is introduced through pipe 29 having valve 22 at an accessible location. A plurality of air vents 24 are located on the top of shell 10. A flexible bag 26 is located on top of the hardenable material, e.g., dry concrete mixture 16. Seawater is allowed to enter the bag 26 through the one-way valve 28.

The invention operates as follows: The packaging procedures described above (except for the introduction of water) are performed on land and then the package is transported to an ocean dumping site. While at sea, an operation is needed to prepare the package for dumping.

Water containing a set retarder is introduced into pipe 20 via valve 22. The water will easily permeate the large aggregate 18 and then slowly start to rise up through the dry filler material 16 by pressure head differential forces and by capillary action. Air in the voids of the dry filler material will be displaced and allowed to exit shell 10 through vents 24. Several hours are usually required to fill all the voids with the water. Water exiting from vents 24 will signal the end of this stage. The valves 29 on vents 24 are then closed along with valve 22. The package is then ready for dumping into the ocean. With water present in the filler material, a high quality fresh concrete mix, which is in a plastic state, surrounds the 55-gallon drums 12. The concrete remains in this plastic state for several hours (long enough to drop the container to the seafloor) and then will "set", that is become a hardened concrete.

Flexible bag 26 is provided for pressure compensation. Under hydrostatic loading, the compressibility of the contents inside the shell; i.e., the plastic concrete mix and the steel drums, allows water to enter bag 26 through the one-way valve 28. Bag 26 is provided to isolate the water from the high quality plastic concrete mix 16. During free-fall to ocean depths of several thousand meters, seawater will enter the bag to maintain pressure compensation. The steel drums 12 normally are not pressure compensated and if so, they will decrease in volume under the pressure loading. The plastic concrete material 16 follows the deflection of the drums 12 and stays in intimate contact with the steel surface. This intimate contact is essential to provide a high quality packaging system.

Reinforcement of various types can be used in the walls of shell 10 if desired.

An alternate configuration of the invention is shown in FIGS. *2a* and *2b* where a shell 10, as in FIGS. *1a* and *1b*, contains drums 12 of waste stacked in a similar manner. However, for this case, a wet concrete filler material 30 is placed around the drums and allowed to harden. A plurality of pipes 32 are placed adjacent to the drums and are embedded in the wet concrete 30, as shown. The pipes 32 are perforated at 34, at about the midlength of each drum. Concrete 30 is prevented from entering pipes 32 by a tape covering the perforations, or by suitable other means, which ruptures at a given pressure. Concrete 30 does not completely fill the shell 10, and pipes 32 are terminated at the same height as concrete 30, leaving a space 38.

Valve 36 is the access to the empty space 38 between concrete 30 and the top of shell 10. A flexible bag 40 is located in the space 38. One-way valve 28 permits seawater to enter into the bag 40. Packaged in this configuration the waste is then transported to the dumping site at sea.

Prior to dumping this package in the ocean, a cement slurry mixture is introduced via valve 36 to fill space 38 and pipe 32. The slurry contains admixtures to retard the set and to prevent segregation by bleeding of the mix water. Valve 36 is closed after the slurry operation, and the package is then dumped into the ocean.

As the pressure load increases during free-fall, seawater enters bag 40 to pressure compensate the interior. The slurry in pipes 32 transmits this pressure load to each drum 12. Drums 12 are not pressure compensated and, therefore, will decrease in volume. The steel wall to the drums 12 will separate from the hardened concrete 30, and the cement slurry mixture will penetrate into and fill this space. Later the cement slurry will harden and provide a high quality barrier around each steel drum.

This invention provides a barrier system that will contain the low-level radioactive waste for periods of time in excess of 100 years. It is known that high quality concrete is durable to the seawater environment. Tests started by the Corps of Engineers in 1905 on large concrete blocks placed on a breakwater at the Los Angeles Harbor have demonstrated the excellent durability of concrete (Haynes, H. H., and Zubiate, P. C., Compressive Strength of 67 year-old Concrete Submerged in Seawater, TN-1308, Naval Civil Engineering Laboratory, Port Hueneme, CA, October 1973). The surf zone is actually the most severe environment for most construction materials, including concrete. Totally submerged concrete is a far more protected environment than concrete exposed to surface conditions. Chemical attack by sulphates in seawater is the major concern from deterioration and this problem is solved by using cement with the proper $C_3A$ content and by producing concrete of low permeability (Mehta, P. K., and Haynes, H. H., Durability of Concrete in Seawater, Journal of the Structural Division, Proceedings of the American Society of Civil Engineers, Vol. 101, No. ST8, August 1975, pp. 1679–1686). The shell 10 is made of high quality concrete, i.e., concrete having a cement content of not less than 700 lbs/yd$^3$, a water to cement ratio of about 0.40, and good compaction (Haynes, H. H., Handbook for Design of Undersea, Pressure-Resistant Concrete Structures, Civil Engineering Laboratory, NCBC, Port Hueneme, CA September 1976).

The permeability of the shell with time can be forecast with accuracy because of an on-going test program on concrete pressure-resistant spheres that are located at depths from 2,000 to 5,000 ft (Haynes, H. H., Long-Term Deep Ocean Test of Concrete Spherical Structures, Part I—Fabrication, Emplacement and Initial Inspections, TR-805, Civil Engineering Laboratory, NCBC, Port Hueneme, CA, March 1974; and, Haynes, H. H., and Highberg, R., Long-Term Deep Ocean Test of Concrete Spherical Structures, Part II: Results after 6 years, TR-869, Civil Engineering Laboratory, NCBC, Port Hueneme, CA, January 1979). Uncoated concrete had a permeability rate of about $10\times10^{-14}$ m/sec. for the first weeks and then decreased to zero at about one year. Steel reinforcement in concrete that is totally submerged is protected from corrosion by the high alkaline environment provided by the cement and by the lack of oxygen at the steel surface. The low permeability of the concrete prevents fresh seawater from supplying the necessary oxygen for corrosion even if the alkaline environment is negated by sufficient chloride ions. Hence the shell 10 provides a good barrier system to contain radionuclides.

An even superior barrier is the concrete produced by the "dry-cast" method in which the dry filter material is wetted just prior to dumping the package in the ocean. U.S. Pat. No. 3,745,954 on dry casting of concrete explains the advantages of compacting the properly graded dry materials to obtain minimum void space and then allowing water to infiltrate the interparticle void system. An extremely low void volume about 4 percent of total volume is obtained which assures a high watertight concrete. (The concrete spheres in the ocean showed zero permeability when the pore volume was about 10 percent.)

It has been stated that during free-fall descent of the package, the concrete filler (which is then still in a "wet" or plastic state) is mobile and stays in intimate contact with the steel drums 12 even though the drums are decreasing in volume. When the "dry cast" concrete sets and cures, which process will begin in a matter of hours, an excellent barrier surrounds the drums to prevent corrosion of the exterior steel surface and to contain any possible leakage of waste material from the 55-gallon drums that might occur due to drum corrosion from the inside.

Impact with the seafloor, which is typically a soft sediment bottom at deep ocean depths, is not envisioned as a problem. However, consideration of impact with a hard (maybe rocky) seafloor indicates that a means to slow down the free-fail velocity of the package should be used. Packages similar to those shown in FIGS. *1a*, 1b, 2a and 2b would have a free-fall terminal velocity about 12 m/sec. A drag apparatus, such as a parachute, attached to the package can be used to slow the descent rate to a safer velocity, around 3 m/sec.

Figure 2A:
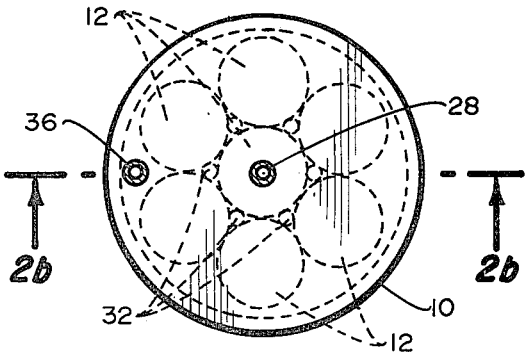
FIG. 2*a* is a plan view of another embodiment of the present invention.
Figure 2B:
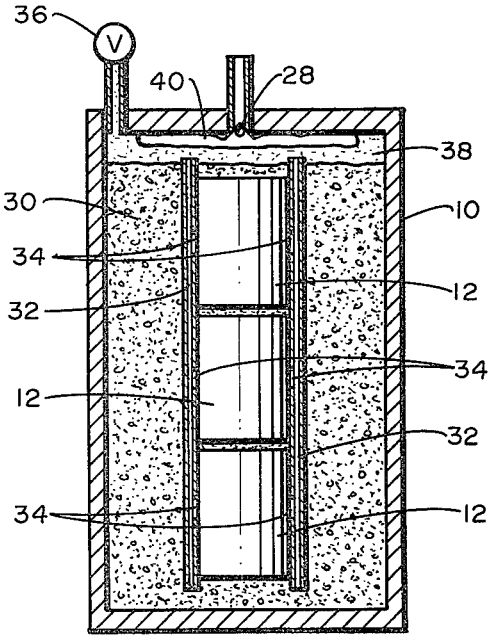
FIG. 2*b* is a cross-sectional elevational view of the packaging structure taken along line 2*b*—2*b* of FIG. 2*a*.

A shell 10 containing a liquid or plastic filler material would have to resist internal radial pressures at impact. The packaging system of FIGS. 1*a* and 1*b* can be reinforced for the radial pressure loads by circumferential prestressing. The packaging method of FIGS. 2*a* and 2*b* can be designed to handle impact with lighter reinforcement in the shell than that of FIGS. 1*a* and 1*b* because the majority of the interior is occupied by presolidified materials. The interior radial pressure will be substantially lower than that of the FIGS. 1*a* and 1*b* system.

For both systems, the impact has the beneficial effect of compacting the plastic filler material or cement slurry to a degree higher than the pressure-compensation system alone can do. The shock effect from impact moves the plastic material more tightly around the 55-gallon drums.

Portland cement concrete has a distinct advantage for packaging materials should an accident occur, such as one structure striking another structure. The impact damage will be localized. The strain energy is absorbed by concrete cracking in the region of impact (the energy is utilized in forming new surfaces). The cracked or crushed concrete is held together by reinforcement in the shell. An exceptional feature of concrete is its autogenous characteristics, or self-healing ability. When cracks are formed, hydrated cement particles are broken which exposes unhydrated cement at the core of the particles. In the presence of moisture which is surely available, the unhydrated cement will hydrate and seal the cracks. Within a period of years, the concrete is restored to a high percentage of its original condition.

Novel features of this invention are the systems by which the filler material is brought into intimate contact with the external surfaces of the steel drums containing low-level radioactive waste and, regardless of changes in pressure and of volume of the drums when the package is placed in the ocean, the filler material is maintained in intimate contact until the filler has hardened into a high quality concrete. The filler provides the first barrier to leakage should the steel drums fail, and the concrete shell structure provides a second barrier to the radioactive material. Pressure-compensation assures the integrity of the shell at any depth in the ocean, and also provides the driving force to assure that the filler material remains in intimate contact with the steel drums.

The filler material 16 or 30 can be any suitable material that is sufficiently hardenable to contain leakage. Other materials that could be used are asphaltic concrete, bentonite slurry, diesel oil cement slurry, and urea formaldehyde resin, for example.

The size of the package structure can be made to enclose any number of steel drums. A concept using 19 drums per layer with 4 layers giving a total of 76 drums, results in a packaging structure of outside dimensions of about 3 m in diameter by 5 m high. The in-air weight of the package is about 900 kN (200,000 lbs.) which means that on-land transport of the package may be impractical due to the requirement for heavy lift equipment. For a structure of this weight, the empty shell could be lifted onto or built on a barge and then filled with drums and filler material.

For packaging structures of even larger size, it may be economically beneficial to have a floating concrete shell that is partially filled with drums and filler material. The unfilled space provides buoyancy while the floating shell is being filled and towed to the ocean disposal site. The shell is then flooded with seawater and permitted to free-fall to the seafloor. The structural configuration could be arranged to provide a stable free-fall descent at a slow velocity. A concept for this approach (free-fall emplacement of a large object on the seafloor in the deep ocean) is presented in U.S. Pat. No. 4,165,707 for "High Lateral Load Capacity, Free-Fall Deadweight Anchor", issued August 1979.

The packaging method presented herein is not limited to housing 55-method steel drums. Drums or other containers of waste of other sizes and construction materials can be packaged as well. If desired, drums or other containers can even be eliminated and waste stored directly in the shell.

Obviously, many modifications and variations of the present invention are possible in the light of the above teachings. It is therefore to be understood that within the scope of the appended claims the invention may be practiced otherwise than as specifically described.

What is claimed is:

1. A packaging system for ocean disposal of low-level radioactive waste material, comprising:

a. a non-degradable exterior shell structure having a top and a bottom and side walls which provides a good barrier to contain radionuclides and being operable to house a plurality of containers of low-level radioactive waste material;

b. a plurality of said containers of radioactive waste material being housed within said shell structure and spaced apart from the interior walls of said exterior shell structure;

c. space between said containers of radioactive waste and between said containers and the interior walls of said exterior shell structure being filled with a hardenable filler material in a plastic state that is operable to be molded about said containers of radioactive waste and hardened, said hardened filler material being suitable to contain any leakage from said containers;

d. a space being provided between the top wall of said exterior shell structure and said hardenable filler material;

e. a pressure-compensation means located inside said exterior shell structure in said space between the top wall thereof and said filler material to provide for pressure-compensation under hydrostatic loading to compress said filler material while in its plastic state during free-fall to the ocean floor while simultaneously isolating seawater from said filler material; whereby as said containers of radioactive waste (which are normally not pressure-compensated) are compressed in volume due to pressure loading, said plastic state filler material will be forced to follow any deflection thereof and stay in intimate contact therewith as the entire assembly comprising the exterior shell structure, containers of radioactive waste and filler material sink to the ocean floor where the filler material hardens to form an intimate barrier against leakage and which also operates to prevent corrosion of the exterior surfaces of said containers;

f. said filler material forming a first barrier against leakage should a radioactive waste container fail, and said exterior shell structure forming a second barrier against leakage of said radioactive waste;

g. said pressure-compensation means assuring integrity of said exterior shell structure at any ocean depth, and also providing the driving force to assure that said filler material is forced into and remains in intimate contact with said radioactive waste containers as it hardens.

2. A system as in claim 1 wherein said exterior shell is of pre-stressed concrete.

3. A system as in claim 1 wherein said exterior shell is of reinforced pre-stressed concrete.

4. A system as in claim 1 wherein said low-level radioactive waste containers are conventional 55-gallon steel drums.

5. A packaging system for ocean disposal of low-level radioactive waste material, comprising:

a. a non-degradable exterior shell structure having a top and a bottom and side walls which provides a good barrier to contain radionuclides and being operable to house a plurality of containers of low-level radioactive waste material;

b. a plurality of said containers of radioactive waste material being housed within said shell structure and spaced apart from the interior walls of said exterior shell structure;

c. space between said containers of radioactive waste and between said containers and the interior walls of said exterior shell structure being filled with a hardenable filler material in a dry unhardened state that is operable to be molded about said containers of radioactive waste and hardened, said hardened filler material being suitable to contain any leakage from said containers;

d. a water supply means being provided to add water to said filler material prior to ocean disposal and prior to hardening, to permit hardening thereof;

e. said supply means operating to allow introduction of water to the bottom of said exterior shell structure where it is then allowed to slowly permeate upward through said dry filler material from the bottom to the top of said exterior shell structure by pressure head differential and by capillary action;

f. at least one one-way vent means being provided at the top of said exterior shell structure for allowing air in the voids of said dry filler material to exit the shell structure as water rises through said filler material;

g. a layer of large aggregate being provided on the bottom of said exterior shell structure to allow water to be evenly distributed across the bottom thereof prior to rising through said filler material;

h. said water supply means including at least one passageway for introducing water at the top of said exterior shell structure to the aggregate layer at the bottom thereof;

i. a space being provided between the top wall of said exterior shell structure and filler material;

j. a pressure-compensation means located inside said exterior shell structure and in said space between the top wall thereof and said filler material to provide for pressure-compensation under hydrostatic loading to compress said filler material while in its plastic state during free-fall to the ocean floor while simultaneously isolating seawater from said filler material; whereby as said containers of radioactive waste (which are normally not pressure-compensated) are compressed in volume due to pressure loading, said plastic state filler material will be forced to follow any deflection thereof and stay in intimate contact therewith as the entire assembly comprising the exterior shell structure, containers of radioactive waste and filler material sink to the ocean floor where the filler material hardens to form an intimate barrier which also operates to prevent corrosion of the exterior surfaces of said containers;

k. said filler material forming a first barrier againt leakage should a radioactive waste container fail, and said exterior shell structure forming a second barrier against leakage of said radioactive waste;

l. said pressure-compensation means assuring integrity of said exterior shell structure at any ocean depth, and also providing the driving force to assure that said filler material is forced into the remains in intimate contact with said radioactive waste containers as it hardens.

6. A system as in claim 1 and 5 wherein said containers of low-level radioactive waste are stacked in spaced apart relationship from each other.

7. A system as in claim 1 and 5 wherein said hardenable filler material is a mixture of ingredients for portland cement concrete.

8. A system as in claim 1 and 5 wherein said hardenable filler material is asphaltic concrete.

9. A system as in claim 1 and 5 wherein said hardenable filler material is bentonite slurry.

10. A system as in claim 1 and 5 wherein said hardenable filler material is diesel oil cement slurry.

11. A system as in claim 1 wherein said hardenable filler material is urea formaldehyde resin.

12. A system as in claim 5 wherein said water added to said filler material contains a set retarder.

13. A system as in claim 1 and 5 wherein said pressure compensation means comprises an expandable flexible bag having a one-way valve for introduction of seawater thereto; said bag isolating the seawater therein from said filler material while maintaining pressure compensation.

14. A packaging system for ocean disposal of low-level radioactive waste material, comprising:

a. a non-degradable exterior shell structure having a top and a bottom and side walls which provides a good barrier to contain radionuclides, and being operable to house a plurality of containers of low-level radioactive waste material;

b. a plurality of said containers of low-level radioactive waste material being stacked within said exterior shell structure and spaced apart from the interior walls of said exterior shell structure;

c. a plurality of tubular passageways positioned adjacent to said radioactive waste containers and extending to a point above said containers and below the top of said exterior shell structure;

d. said tubular passageways being perforated near the midlength of each said container of radioactive waste; said perforations being covered with a closure rupturable at a given hydrostatic pressure;

e. the spaces between said containers of radioactive waste and the bottom and sidewalls of said exterior shell structure being filled substantially to the top of said tubular passageways, but not within said tubular passageway, with a solidifiable filler material introduced in a moldable plastic state and hardened therein;

f. a space being provided between the top wall of said exterior shell structure and the tops of said tubular passageways and said sdolidifiable filler material;

g. a first valve means allowing access from outside said exterior shell structure to the space between the top thereof and the top of said solidifiable filler material;

h. a pressure-compensation means located within said space between the top of said exterior shell structure and the top of said solidifiable filler material to provide for pressure compensation under hydrostatic loading to compress any plastic state material within said space during free-fall to the ocean floor of the assembly (comprising said exterior shell structure, radioactive waste containers and filler material) while simultaneously isolating seawater from said filler material;

i. a cement slurry mixture, which is introduced into said space and said tubular passageways via said first valve means prior to ocean dumping and free-fall to the ocean floor of said assembly, being operable to be compressed by said pressure compensation means and forced through said tubular passageways and through said perforations rupturing said closures to follow any deflection of said radioactive waste containers (which are normally not pressure-compensated) as they are compressed in volume and tend to separate from said solidifiable filler material due to pressure loading; said cement slurry being forced around the compressed radioactive waste containers under pressure, and hardened in place as the assembly rests on the ocean floor to form an intimate barrier against leakage and which also operates to prevent corrosion of the exterior surfaces of said containers.

15. A system as in claim 14 wherein said exterior shell is of pre-stressed concrete.

16. A system as in claim 14 wherein said exterior shell is of reinforced pre-stressed concrete.

17. A system as in claim 14 wherein said low-level radioactive waste containers are conventional 55-gallon steel drums.

18. A system as in claim 14 wherein said containers of low-level radioactive waste are stacked in spaced apart relationship from each other.

19. A system as in claim 14 wherein said solidified filler material is formed from a mixture of ingredients for portland cement concrete.

20. A system as in claim 14 wherein said solidified filler material is formed from asphaltic concrete.

21. A system as in claim 14 wherein said solidified filler material is formed from urea formaldehyde resin.

22. A system as in claim 14 wherein said cement slurry mixture contains a set retarder.

23. A system as in claim 14 wherein said pressure-compensation means comprises an expandable flexible bag having a one-way valve for introduction of seawater thereto; said bag isolating the seawater therein from said cement slurry mixture while maintaining pressure-compensation.

* * * * *